US005371854A

United States Patent [19]

Kramer

[11] Patent Number: 5,371,854

[45] Date of Patent: Dec. 6, 1994

[54] SONIFICATION SYSTEM USING AUDITORY BEACONS AS REFERENCES FOR COMPARISON AND ORIENTATION IN DATA

[75] Inventor: Gregory Kramer, Garrison, N.Y.

[73] Assignee: Clarity, Portland, Oreg.

[21] Appl. No.: 947,259

[22] Filed: Sep. 18, 1992

[51] Int. Cl.[5] ..... G10L 9/00

[52] U.S. Cl. ..... 395/2.79; 395/2.67

[58] Field of Search ..... 395/2.79, 2.81, 2.82, 395/2.83, 2.67; 381/51-53

[56] References Cited

U.S. PATENT DOCUMENTS

| | | | |
|---|---|---|---|
| 4,359,713 | 11/1982 | Tsunoda | 395/2.83 |
| 4,363,482 | 12/1982 | Goldfarb | 395/2.81 |
| 4,825,385 | 4/1989 | Dolph et al. | 395/2.83 |
| 4,949,274 | 8/1990 | Hollander et al. | 395/2.79 |

*Primary Examiner*—Allen R. MacDonald

*Assistant Examiner*—Michelle Doerrler

*Attorney, Agent, or Firm*—Myron Greenspan

[57] ABSTRACT

A system for using sound to display data which includes the capability of storing, manipulating and retrieving data and data-to-sound parameter mappings for the purposes of controlling a sound generator with the data such that auditory reference beacons result. These beacons may be used to compare to sound resulting from the incoming data and/or to other beacons to orient a system user within a complex data set, and to enhance comprehension of system status and trends in the data. Incoming data to become the data component of the beacon generator is stored in memory, then, when recalled, is injected into a sonic map. The sonic map formats the data for control of the sound generator and routes it to selected parameters of a sound generator. By manipulating the beacon data and the sonic map, a flexible means of data inspection and reference are obtained.

20 Claims, 12 Drawing Sheets

| | |
|---|---|
| 0 | D 0 |
| 1 | D 1 |
| 3 | D 3 |
| 8 | D 8 |
| 11 | D 11 |

SONIFICATION SYSTEM USING AUDITORY BEACONS AS REFERENCES FOR COMPARISON AND ORIENTATION IN DATA

BACKGROUND OF THE INVENTION

1. Field of the Invention

This invention relates generally to the field of measuring and testing and data comprehension and, particularly, to a technique for using sound to identify particular states of a system by storing, manipulating and retrieving data that indicates the status of the system being monitored and using this data as a control source for sound.

2. Description of the Prior Art

A. Introduction

In the fields of measuring and testing and of data comprehension, the primary tools used for user feedback have been visual displays. This includes alphanumeric readouts, dials, indicator lights, computer graphic displays, and so forth. Additionally, auditory feedback has been employed primarily in the form of alarms which sound when certain thresholds are crossed. The purpose of these visual displays has been to provide detailed information about the system being monitored. However, auditory feedback has not been widely employed to provide detailed and continuous information.

As the systems being monitored become increasingly complex, with more individual variables to attend to, a means of integrating the displays may be desirable. This integration allows the system user to make sense of the data he or she is receiving. To this end, color coded meters, 2 and 3 dimensional charts, complex computer displays, and other visual feedback means have been developed (E. Tufte, "Visual Display of Quantitative Information" Connecticut: Cheshire Press, 1983).

In many applications where there are more variables than can be easily integrated into a single visual display, and/or in systems where visual monitoring of displays is not always practical, such as while driving a car or operating machinery, or when the system is being monitored by a vision impaired individual, it may become desirable to use sound as the "display" medium for monitoring the system. We will refer to this use of sound as sonification.

A simple example of sonification might involve controlling a sound's intensity, pitch, harmonic content (brightness), and spatial location to indicate the state of four distinct variables in a system or process being monitored. In order to represent higher dimensions, more complexity is required of the sound. This complexity can be obtained by creating simultaneous auditory streams (polyphony) or by generating a single sound stream with many variables of the sound changing simultaneously.

The use of increasingly complex variables and manipulating variables on different time scales to convey high dimensional information are salient features of sonification. In order to create such complex and multi-variate sounds, the data streams of the system to be displayed auditorially must be translated into a suitable format for controlling a sound generating unit. These formatted control streams are then routed, or 'mapped' to selected auditory variables such as pitch, brightness, etc. In this way, a single auditory stream may display multiple data streams.

When a complex auditory stream is used to convey the data, an important perceptual process comes into play. In addition to the system user's ability to scan his or her attention through the sound, relationships between variables and entire system states are perceived 'at a glance'. Which is to say, without attention directed effort, all of the auditory variables are perceived as a whole. In addition to a sound being, for example, bright in timbre, high in pitch, pulsing quickly, and loud, it is all at once recognizable as a whole entity.

B. Prior Sonification Work

In the early 1950's Pollack and Ficks (I. Pollack and L. Ficks, "Information of Elementary Multidimensional Auditory Displays", Journal of the Acoustical Society of America, Vol. 26, Number 2, pp. 155–158, March 1954.) published a paper on the use of sound to display data which used a simple binary display technique. They took eight variables and had the test subjects determine whether each variable was in one of two states, e.g. loud or soft, long or short, etc. They concluded that this was an effective technique for conveying data but that "extreme subdivisions of each stimulus dimension does not appear warranted." Later works by E. Yeung (E. S. Yeung, Pattern Recognition by "Audio Representation of Multivariate Analytical Data", Analytical Chemistry, vol. 52, pp. 1120–1123, 1980) and S. Bly (S. Bly, "Sound and Computer Information Presentation", Unpublished dissertation, U. of California, Davis, 1982.) have since explored different techniques, including continuous variation of audible parameters. For an overview of work done to date, the reader is referred to S. Frysinger's "Applied Research in Auditory Data Representation", (Proceedings of the SPIE, E. J. Farrell, Ed; Vol. 1259, pp. 130–139, Bellingham, Wash., 1990). Another example of sonification is the auditory element of "Exvis". a data visualization and sonification software program from the University of Mass. at Lowell.

In a related development, a number of coinposers are using mathematically generated complexity to create compositional forms and/or synthesize sounds. The works of Truax (B. Truax: "Chaotic Nonlinear Systems and Digital Sound Synthesis: An Exploratory Study", Proceedings of the ICMC, Glasgow, 1990), Chareyron (J. Chareyron, "Digital Synthesis of Self-modifying Waveforms by Means of Linear Automata", Computer Music Journal, S. Pope, Ed., vol. 14, #4, MIT Press, 1990., and many others can be cited as examples. The primary difference between sonification and composition as regards embedding information in an audio stream is that in sonification the subsequent extraction of the data for the purposes of understanding the generating system is a primary consideration. In composition this is usually not the case.

In addition to the above cited research, two patents of importance to the present invention are referenced. The first, a patent of W. Kaiser and H. Greiner, ("Warning System for Printing Presses", U.S. Pat. No. 4,224,613), teaches the use of multiple auditory streams to monitor multiple independent data streams. The second, an invention by E. Fubini, A. De Bono, and G. Ruspa, ("System for Monitoring and Indicating Acoustically the Operating Conditions of a Motor Vehicle", U.S. Pat. No. 4,785,280), teaches the use of several parameters of a single auditory stream generated by a sound synthesis system to monitor several data streams.

C. Similar Data Structures for Musical Applications

There are developments in computer music software and hardware that mirror the developments in sonification software. The similarities in file types do not reflect a similarity in function.

In music software, it is common to store data representing musical information such as notes, musical dynamics, tempos, and so on. It is also common in music software and hardware to have files which represent the values of sound parameters which, when retrieved, cause a sound synthesizer to produce a certain timber (sound quality) when played. The musical data file type, commonly found in software 'sequencers' (see the "User's Manual for Vision", by Opcode Systems, Menlo Park, Calif.), and the second, commonly accessed via the front panel of music synthesizers as 'sound presets' (see "User's Manual for the Korg 01W", Korg U.S.A., Westbury, N.Y.), may roughly correspond to the data component and the sonic map component of auditory beacons, respectively. However, these systems were not designed to be used as described in this disclosure, nor is there any description in any known existing publication of how they may be used to create auditory beacons for data monitoring and comprehension.

SUMMARY OF THE INVENTION

The present invention offers the sonification system user a means of identifying particular states of the system and, by referring to those states, to grasp the overall status of the system and to orient themselves in the multi-dimensional space defined by the various independent data streams. Thus the system allows the system user to generate and compare alternate auditory 'views' of the data to enhance comprehension.

To achieve this goal of identifying, comprehending and orienting in data environments, the present invention describes a technique for using sound "beacons" to identify certain states of a sonification system and using multiple data/sound mappings as an aid to comprehending those different states. The ongoing auditory output of the sonification system will be referred to as the sonic data stream, which is to say a sonic representation of the data stream(s). The beacon is a point or region within that sonic data stream.

By auditory beacon (hereinafter referred to simply as "beacon") we mean an auditory reference by means of which a system user can orient themselves in a data space. Two primary components of the sonification system which can generate beacons are defined. The first is the data component and the second is the data-to-to-sound parameter map, or the sonic map.

The data component of a beacon generator is a stored set of data points which are used to control a sound within a sonification system. The map component of a beacon is the means by which the data are routed to selected auditory parameters of the target sound generator. Via the map, the data values are audibly represented by the sound generator.

The Data Component

As stated above, the data component of a beacon is a stored set of data values which are used to control a sound within a sonification system and thus serve as reference points within that system. The data component may be stored and retrieved independent of sound synthesis techniques and data-to-sound parameter mappings. An auditory beacon is a combination of the beacon data with the data-to-sound-parameter map (implicit in which is the synthesis technique used for the sonification), the net result of which is a complete description of the values and variables used to generate a particular sound.

The data values may be stored in their entirety in a memory location, or an index may be stored which points to an address in the data file where the data points are stored. This may more efficiently represent the data. The net result is identical. (Note that when a pointer to a file is used, it is assumed that a large set of sequential data values is assumed to be stored somewhere, either in a large memory or on some storage medium such as hard disk. The pointers then reference discrete points or regions within this data set.)

These data values, which are subsequently used as control means for an audio signal, may be fixed at a given state or they may have a well defined time-varying shape, wherein each controlling data stream changes over the course of the recorded beacon interval, typically a time span of 0.5 to 3 seconds. A beacon using a single data point (however many dimensions define that point), i.e. with no variation in time, will be referred to simply as a beacon, or a static beacon. A beacon using time-varying data will be referred to as a "dynamic beacon".

Dynamic beacon data, stored as either a stream of data values or a beginning and end point of an index that points to the addresses of the stored data, can represent, for example, a two second segment of a simulation. It can also represent 2 seconds of sequential playback of spreadsheet data, with the user having specified the playback rate of the data. When mapped to the sound generating means, a 2 second sound 'phrase' would result. The system user can then change the mappings and replay the same data segment, replay different dynamic beacons sequentially, compare dynamic beacons from different points in a procedure, and so on. Due to the dynamic nature of this technique, features of the system may be highlighted that would be overlooked by static beacon data.

Because a beacon refers to the beacon data combined with the data-to-sound-parameter map, the result is a complete definition of the system producing a sound. Thus, each time the beacon is referenced it sounds the same. Put another way, a beacon is a sound which represents data and is readily identifiable by the state of its component parameters. If the controlling data or the mappings change, a different auditory beacon results.

Sonic Maps and Alternate Auditory Views

Once the data component of a beacon is selected, it is employed as a means of controlling the sonic qualities of a particular sound generation scheme. As described above, the means by which the data are routed to selected auditory parameters is known as a "sonic map". Through the use of the sonic map, the data values are audibly represented by the selected sounds of the target sound generator. The data component, then, corresponds to different 'snapshots' of the data, representing different system states. These states can then be easily compared by injecting data values into the sound generating means. If a new sonic map, possibly including another sound generation method, is implemented, the same data points are represented by the new auditory beacon.

Changing a map .may also involve invoking a configuration in which entirely different sound parameters are possible destinations for the controlling data. For example, data stream #1 may control onset time and data stream #2 may control vibrato of a sound which is made up entirely of harmonic partials and is pulsed in nature. An example would be a cello-like sound repeatedly playing short notes.

A change in the mapping which includes a change in syntheses technique may create a sound similar to ocean waves. Since onset time and vibrato would not apply to a continuous and noisy sound, these variables would no longer be available in the map. In this case, data streams #1 and #2 might be used to control the noise content and rapidity of the sound.

Since the map, by definition, encompasses the parameters of the sound generator, we refer to changes in the routings as well as changes in the routings plus the synthesis technique as changes in the map. When we refer to changes in the map, it is understood that this implies a compatibility with the existent synthesis technique and its associated available sound parameters.

There are several reasons to use alternate mappings. Because different auditory variables interact differently with various aspects of the human auditory perception system, they tend to be perceived as being more or less compelling. By selecting different sonic maps, then, different aspects of the presented information are highlighted. It may be possible to develop a rating system for different auditory variables, comparing the relative strengths (in terms of how compelling they are when perceived by the system user). For example, a very compelling variable such as the frequency of the sound generator tone, may be given a high rating and a less compelling variable such as the attack time of the tone may be given a lower rating. Parameters with higher ratings could be controlled by different data via the use of different mappings, with the result that different maps would serve to highlight different aspects of the same data.

In addition to highlighting different data because of these different levels of compulsion, different auditory variables also employ different perceptual capabilities and pattern-recognition capacities of our auditory systems. Thus, different sonic maps also provide alternate insights into the data even when sound parameters of equivalent strength are employed.

Two schemes are presented for employing these sonic maps. The first is the automation of map selection, such that different maps are recalled in a selected sequence for purposes of comparison. The second is the interpolation between maps, wherein data sets are cross-faded between auditory parameters. (This may be likened to rotating an object in a computer visualization.)

Map Sequencing:

When investigating a set of (multi-dimensional) data points, it may be desirable to compare different sonic maps to highlight different aspects of the data. In order to efficiently compare several mappings, the system user may automate the map selection by automatically retrieving multiple map files in sequence. The result is a single data set causing different sounds to be generated, most likely in a fixed rotation, while the system user compares the different sounds for insights into the data.

Map Interpolation:

There may be cases where sequencing between mappings is complicated by the use of different sound synthesis techniques. A new synthesis technique may be implemented and the new sound parameter file may have a greater or lesser number of target parameters to control with the data streams. It may be desirable to effect an interpolation scheme whereby each data stream is gradually shifted to control of one or more variables according to a predetermined scheme. This scheme could include rules to determine which target parameters are to be given priority for being used in tandem with other target parameters and what kinds of grouping of parameters for control by one data stream will be implemented. This interpolation can become complex and this disclosure is not limited to a particular interpolation scheme.

Combining Data Manipulation With Map Manipulation

The manipulation of the data and map components of beacons together constitute a versatile means of investigating a data set via the use of sound. By changing the data set while maintaining the mappings (and vice versa), the data can be flexibly inspected.

For instance, one might use a data file to control a sound. One might then go on to save a few subsets of this data that describe states which seem interesting when sonified. One could then maintain the sonic map and employ different beacon data, thereby developing a stable auditory reference and comparing different data sets within that reference. An obvious extension is to change mappings (and possibly the associated sound generation techniques) and compare different 'views' (beacons) of the same data set.

So we see how the data component of beacons directly represents system parameters at a point (static) or region (dynamic) in time, while beacons refer to the auditory state of the system at that point (or region). Both uses of beacons have specific applications. For example, the data component of a beacon can represent a critical event in a simulation, and several different auditory beacons may be made from it, each assigning different variables to different sonic parameters. By listening to these different auditory beacons, the most salient features of the critical event may be represented.

On the other hand, different beacons may be compared, each of which refers to different data sets, all having the same data-to-sound-parameter map. In this way, the important variables from the separate data sets (be they from distinct runs of a simulation/measurement or simply from different points within a simulation/-measurement) may be compared using a consistent auditory framework.

BRIEF DESCRIPTION OF THE DRAWINGS

Further characteristics and advantages of the system according to the invention will become apparent from the detailed description which follows, given with reference to the appended drawings, provided purely by way of non-limiting example. The drawings are block schematic diagrams of several manners of realization of the invention.

DESCRIPTION OF THE PREFERRED EMBODIMENT

Figures 1A, 1B:
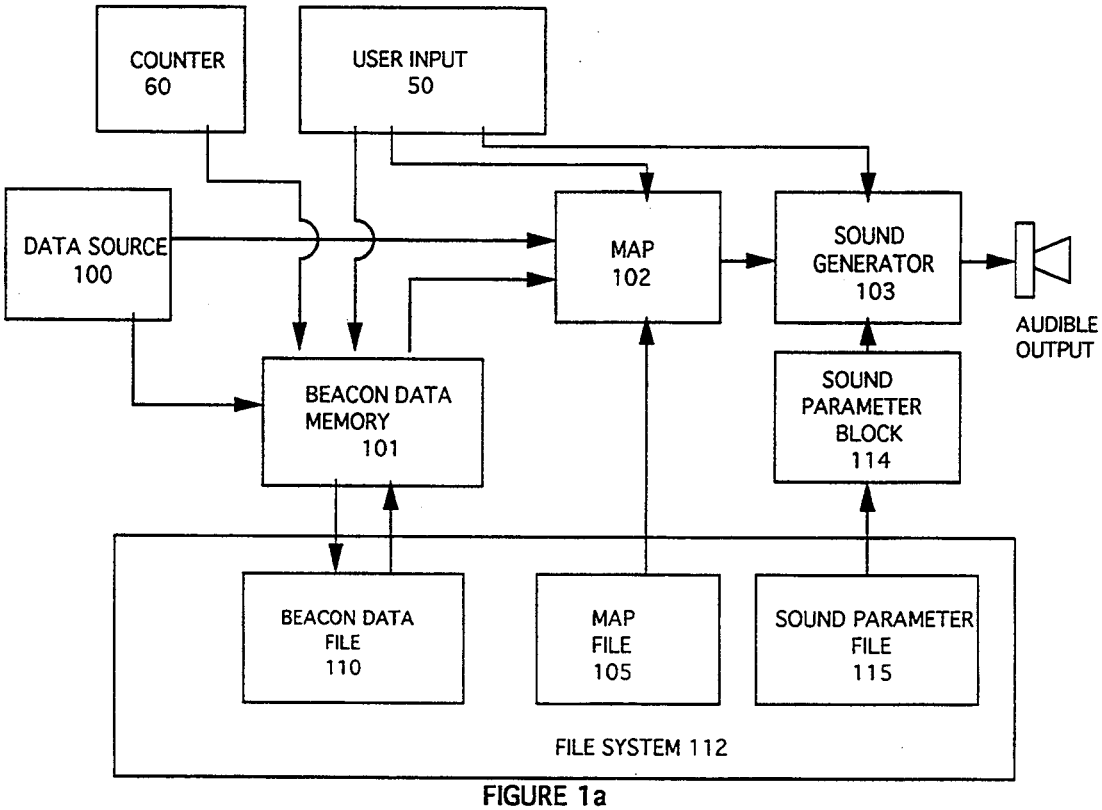
FIG. 1*a* describes the general structure of a sonification system that can generate auditory beacons.
FIG. 1*b* shows how the data and its pointer index may be stored together in the Beacon Data Memory shown in FIG. 1*a*.

FIG. 1*a* describes the general structure of a sonification system that can generate auditory beacons. The user input block 50 allows the system user to interact with the system. This can include storing and retrieving beacon data, mappings and sound generator parameters, starting and stopping the data source, etc. When the user initiates the beacon storage, incoming data is stored in the beacon data memory 101. Depending on whether the user has initiated a static or dynamic beacon, either one or multiple sets of data values will be stored. The user can also initiate permanent storage of a beacon by having it transferred to the computer's file system 112. In such cases, the user must supply a file name which will thenceforth be associated with that beacon. A corresponding beacon data file 110 will then be created by the computer's operating system. Beacons may be recalled from the file system (by name) and placed back in the data memory.

The data, as either several parallel data streams or one multiplexed data stream, is then mapped to sonic quantities via the map 102 prior to being converted to audible output by a sound generator 103. The sound generator is capable of responding to the multiple or multiplexed data stream(s). Static parameters for the sound generator are stored in the sound parameter block 114. Different sets of mapping parameters and sound generator parameters are also stored in the file system 112. Again, specific files are associated with each of these, being the map file 105, and the sound parameter file 115.

It is also possible to store information in the file system specifying the particular sound generation technique to be used by the sound generator 103. This may be as simple as a number which indicates which of a group of possible sound generation algorithms to employ. On the other hand, if the sound generator is a programmable digital signal processor (DSP), it is possible that the code the DSP is to run would be 'downloaded' to the sound generator from the file system.

By using a computer-based file system, additional flexibility is achieved. For example, when a new mapping is desired, the contents of the desired map file 105 are transferred from the computer's file system 112 into the map unit 102. The combination of beacon data memory 101, map 102, sound generator 103, and sound parameter block 114 may be understood collectively to be the beacon generator, since it specifies completely the auditory state of the system.

By changing mapping parameters, the user specifies how each input data variable is displayed by an auditory parameter and at what scale. For instance, the user may choose to map input variable 3 to the duration of a repeating pulse, whose duration may range from 40 to 400 milliseconds. The particular selection of this auditory parameter for the given input variable as well as the range the auditory variable will take when mapped to the range of the input variable are determined by the map. As mentioned, multiple maps may be stored in the file system so that the data may be assigned to different sonic variables with different weights to facilitate the analysis.

By changing values within the sound parameter block 114, the user can affect the fixed characteristics of the sound generator 103 which are independent of the data emerging from the map 102. For instance, a four operator FM synthesis technique may have as many as 8 specific configurations of operators used to generate the sound. The selection of the particular algorithm in use may be part of the sound parameter block. Another example would be in changing the overall equalization of the final output signal to bring out certain aspects of the data-to-sound transformation.

As shown in FIG. 1*b*, the beacon data may be stored together with an index generated by the counter 60 (FIG. 1*a*). This information may be used in interpolation schemes described later to enable the user to specify sequences of beacons by creating a list of index values.

EXAMPLES OF BEACON APPLICATIONS

Two examples of how beacons may be used follow. The first example relates to a manufacturing system, where the system user has little control over the beacons. The second describes a data analysis task where extensive control of beacon generation is provided to the system user.

Using beacons, a sonification system user can become familiar with a given set of beacons and compare, for example, the running status of a manufacturing control system, to a reference beacon representing the ideal status of the system. This enables the system user to quickly identify system problems and make adjustments based upon auditory feedback. Note that in this example, the system user does not control the beacon data or the sonic maps, but only accesses them to create auditory results as points of reference.

For example, if a worker in an injection molding factory is required to visually monitor the quality of the product emerging from the injection molding machinery, it may be difficult for him to also monitor the various parameters of the machine that effects the molding process. Such variables may include input temperature, output temperature, pressure, and viscosity. In order to allow the worker to continuously monitor these variables, one could provide a sonification wherein the input temperature is converted to a control signal for the pitch of a sound generator, output temperature is converted to a control signal for the vibrato of that sound, the pressure signal is used to control brightness and the viscosity signal is used to control roughness of the sound.

By listening to the changing sound, the system user is able to continuously monitor the status of the molding machinery without taking his eyes off of the machines output. However, if he looses track of the sound that represents the normal state, how is he to know if the current state is normal or abnormal? By pressing a preconfigured "normal beacon" button, he causes a sound to be played back that represents the normal state. By quickly comparing the resultant sound to the sound being produced by the machine, he is able to tell if one is rougher, higher, brighter, and so on than the other. Likewise, if he believes that the sound indicates that the system is headed towards a certain malfunction, he can press a button representing that malfunction and hear what sound would be produced by the sonification system when that state is reached. By comparison he can then determine if he is headed in that direction or not.

In this second example, the system user, a financial data analyst not only records and accesses different beacons (static and dynamic), but sequences these beacons to compare different system states. Using dynamic beacons, a person can be trained to recognize certain sound phrases that represent desirable (or undesirable) system states. For example, a stock market analyst can become familiar with the sound of a favorable trend and make purchasing decisions based upon hearing that trend.

A data analyst using a sonification system to spot trends in the stock market may begin by listening to the sonification of data representing one year of daily closing values of five target stocks. Let us say that these values for companies 1–5 are being used to control pulsing speed, brightness, loudness, pitch and onset time of a sound. For each set of different closing values, then, a different sound results. While playing back the data file, the analyst hears a point of interest and presses the "record beacon" button on the sonification system. At the point that she presses the button, the current data values are stored in a memory location and given a label for future recall (e.g.. "beacon #1). When she hears another state, she may do so again, and another beacon data set is stored, and so on.

Now, wishing to compare, let us say, the August 4 data with the October 14 data, she stops the data flow from the stock market data file to the sonification system. Now she presses the beacon #1 button, then the beacon #2 button on her computer screen. Pressing each beacon button causes the corresponding data set to be injected into the sonic map and thence to the sound generator, causing two distinct sounds representing those data sets to be played. By comparing the two beacons, she gains insight into their similarities and differences. Now, she changes the sonic map and plays the same beacon data. Different sounds result, and so different aspects of the two data sets are highlighted. (see "Sonic Maps and Alternate Auditory Views", below.)

Now, wishing to hear these data points in a context, she specifies that the week proceeding and following each data point also be played back. The result is a 1 second phrase for each beacon, a dynamic beacon. Now, seeing that the August 4 beacon was at the beginning of a certain change and the October 14 beacon was in the middle of that 'phrase', she ascertains that a trend she first expected is not likely to materialize. So she selects another beacon from November 22 that had similarities to the August beacon and plays it back as both a static beacon and a dynamic beacon. Now sequentially playing back August and November beacons adjacent to each other, she hears expected similarities. Based upon these perceptions, she decides to purchase one stock and sell another.

Figure 2A:
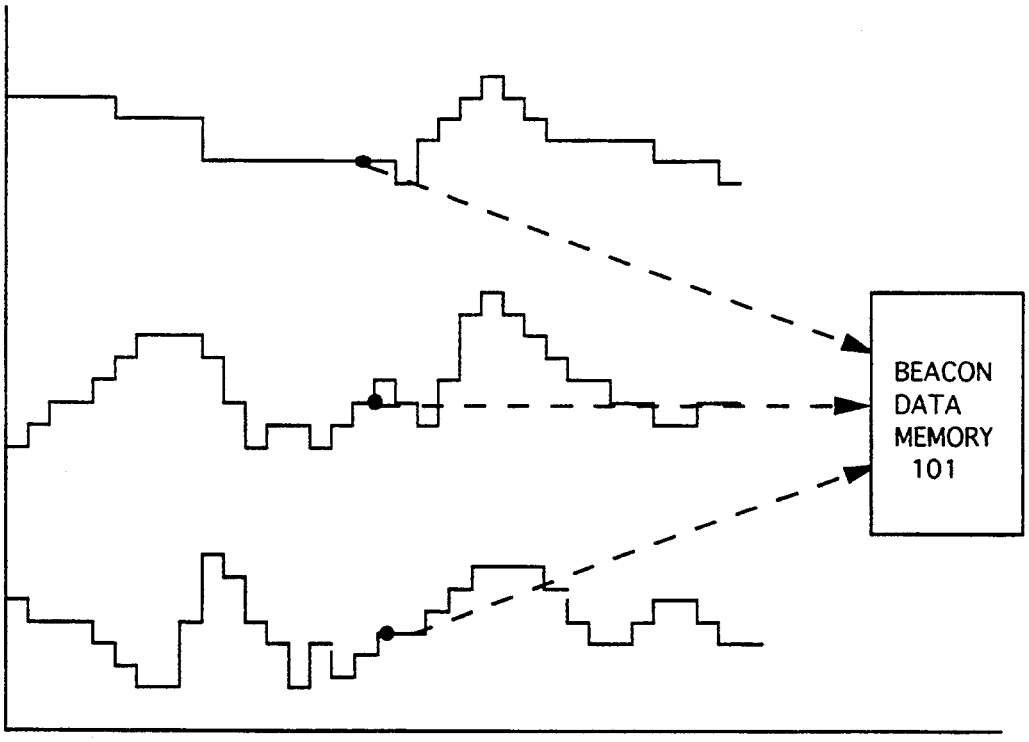
FIG. 2*a* is a sample graph of time varying data with indications of how data at a given time are stored to create static beacon data.
Figure 2B:
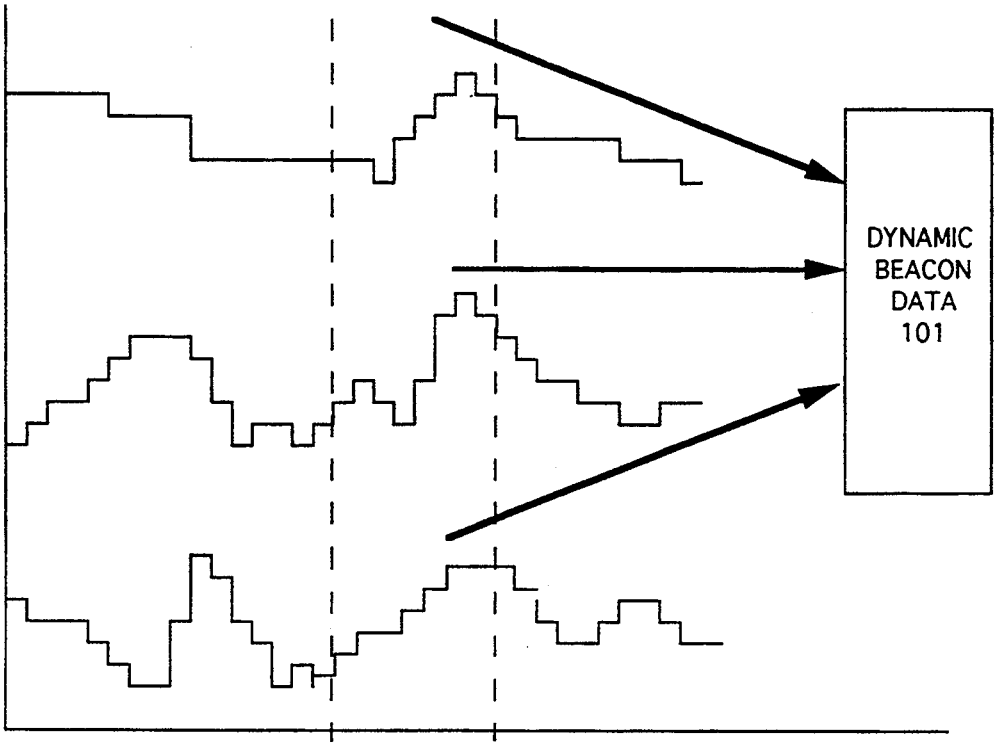
FIG. 2*b* is a sample graph of time varying data with indications of how a group of data .points within a given window are stored for future recall as dynamic beacon data.
Figure 2C:
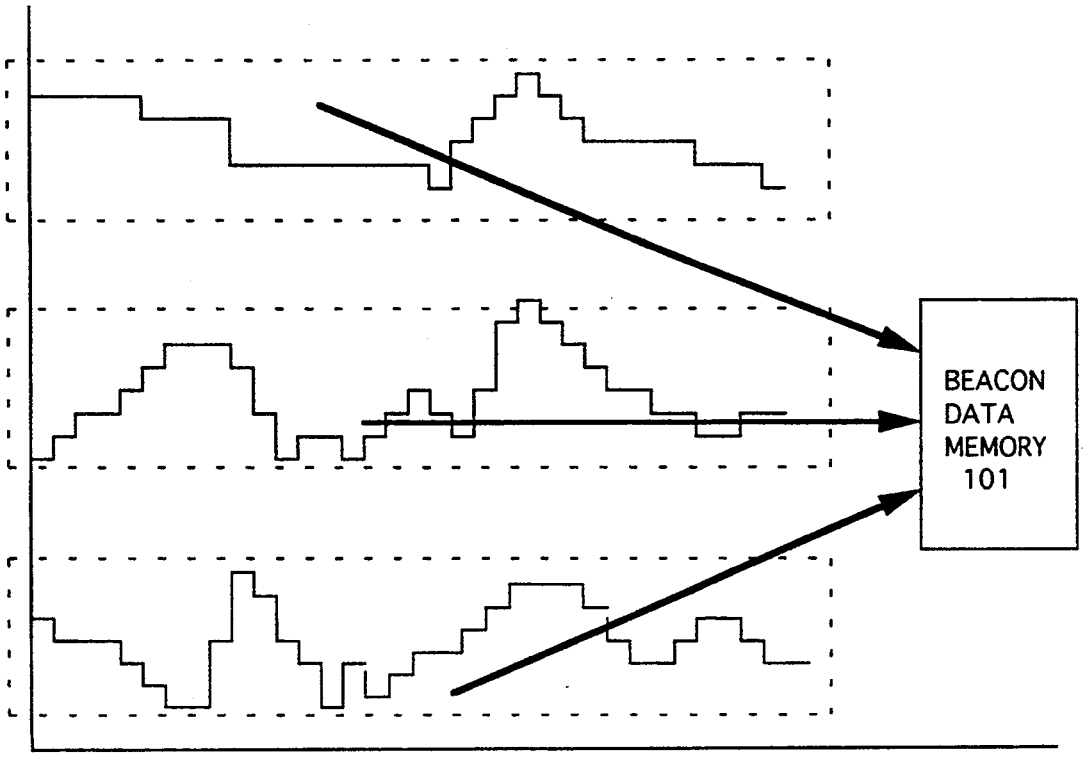
FIG. 2*c* is a sample graph of time varying data with indications of how the entire data stream is captured to create a beacon data file.

FIG. 2*a* is a sample graph of time varying data with indications of how data at a given time are stored to create static beacon data. The graph shows pictorially the evolution of several variables being measured or simulated. When the user initiates the creation of the beacon data, the values of each of these variables are stored directly into the beacon data memory (101). As explained above, a counter value can also be stored, representing the index of this stored value (or group of stored values). FIG. 2*b* is identical to 2*a* except that it pertains to the storage of dynamic beacon data, where a range of values is stored. This range, or window, is typically provided by the user, for example through holding down a button throughout the duration of the event of interest. FIG. 2*c* represents the case where all of the values being measured are recorded. This would be the case if the user's system has a large amount of storage available and/or an entire process must be recorded from start to finish (for example, in a data logging application). It is in this scenario where the use of pointers to store and retrieve beacons become most useful, since all possible data is present in a single large file, and pointers can be stored which index into that file.

Figure 3A:
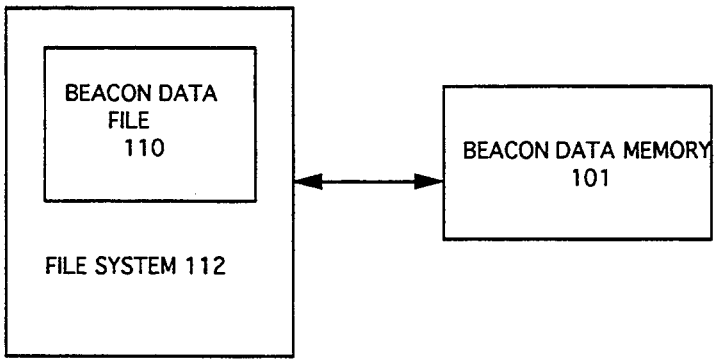
FIG. 3*a* shows how the data component of beacons can be stored and retrieved from a computer's file system.
Figure 3B:
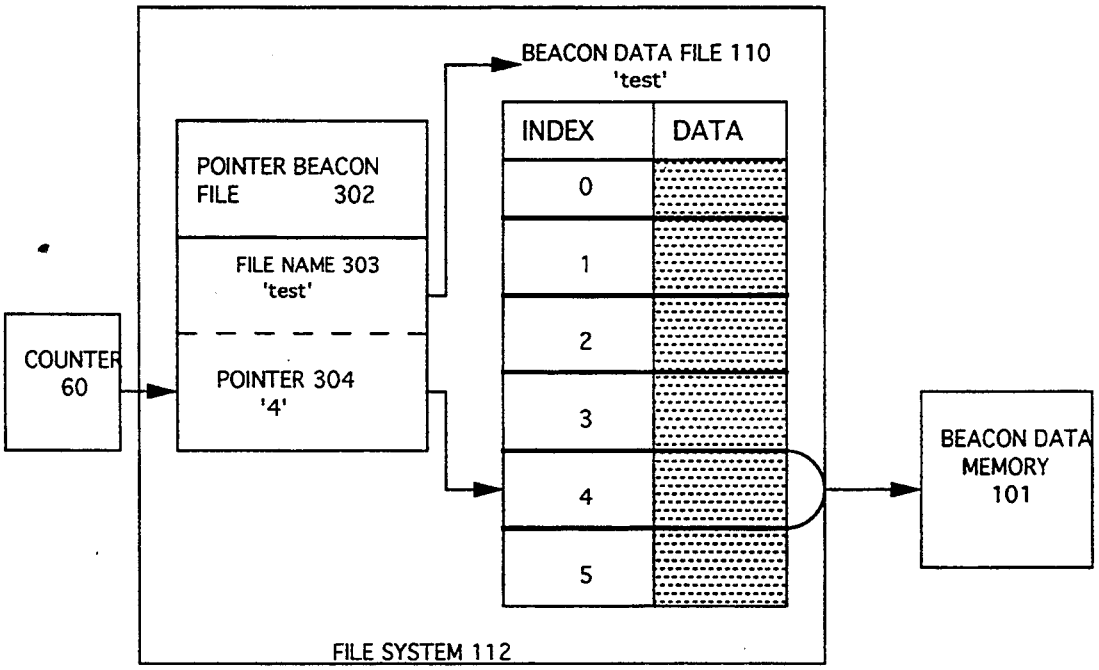
FIG. 3*b* shows how a pointer may be used to store and retrieve the data from a computer's file system for a static beacon.
Figure 3C:
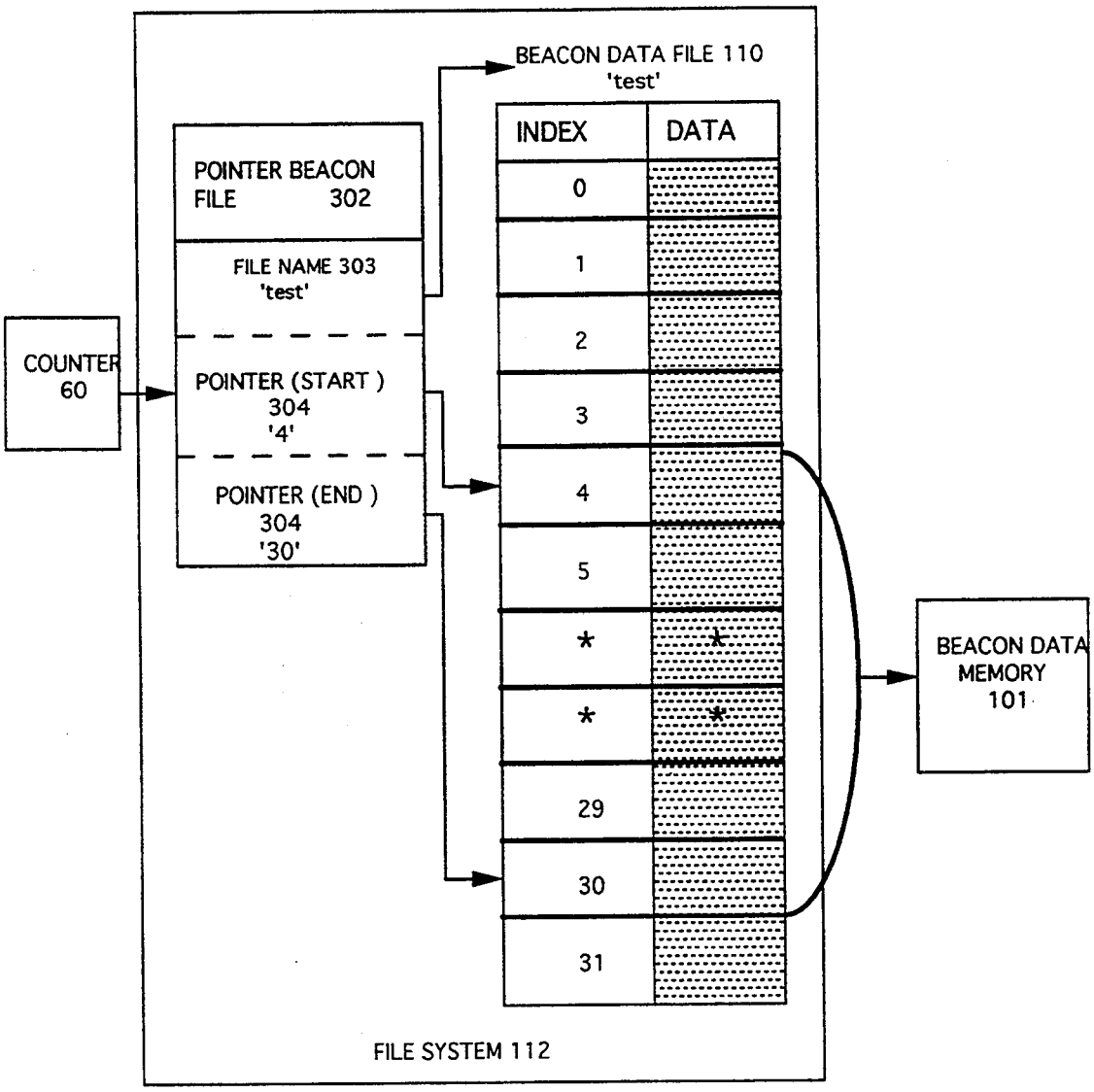
FIG. 3*c* shows how pointers may be used to store and retrieve the data from a computer's file system for a dynamic beacon

At any time, the user may wish to remember a particular data value or values for comparison. The user can then initiate the recall of either an isolated point or a range of points frown the file system. The recalled data will then be placed in the beacon data memory (101) by the computer. Alternatively, the user may wish to create a new file containing the current incoming data value(s). In this case, the operating system will create a file, and beacon memory data will be transferred into it by the computer. These storage/retrieval operations are illustrated in FIGS. 3*a*, 3*b*, and 3*c*.

Beacons and File Systems

There are two different scenarios involved when distinguishing between beacons where the data is stored directly and beacons where pointers into a data file are stored. If only specific data values from the process or simulation are to be stored, letting the intervening values be discarded, then these data sets represent the data components of the beacons directly, and there is no need for pointer-based beacons.

On the other hand, there are situations when all of the data being examined is sampled (typically at a fixed sample rate) and stored somewhere, for example on a hard disk. In this case, both directly stored data and pointer-based data storage have relevance. The data component of beacons represent subsets of the larger data set that have been transferred to a memory prior to being transformed into controls for auditory signals. Pointer-based beacons use pointers to points or regions in the larger data set which must subsequently be transferred to the memory prior to being transformed into auditory signals.

Of course it is possible in many implementations to transfer the data directly from storage without the intervening memory. In this case, the only beacon memory required is that used to store the pointers into the large data set. The function of direct data storage and pointer-based data storage is identical; the difference between the two is one of implementation.

These techniques can be implemented using either a dedicated hardware system under microprocessor control, or a computer with software to manage the files representing the data and auditory beacons. A software implementation would take as its data source either another software package running on the computer (or on another computer) or values read from an A to D converter. It may employ the sound generating capabilities of the host computer or hardware added (internally or externally to the computer) for sound generation. A hardware implementation may have an input for digital or analog signals, sound synthesis capability, and memory means for storing the beacon data as well as activation means for recalling the beacons.

The data from the system being monitored is recorded into one or more memory locations. In the case of a static beacon, this will typically consist of a single value for each data stream that is controlling the sound or an index value pointing to the memory locations where these data values are stored. In the case of a dynamic beacon, it will either be a series of sequentially recorded data points for each data stream or a pair of indices representing the beginning and end points of a range of data values. If the data is stored in a file, the number of points stored will be a function of both the duration of the beacon and the number of samples per second taken of the data stream.

These data sets are then recalled by the system user any time the beacon activator is initiated, such as by clicking on a beacon symbol with a pointing device. When the beacon is activated, the previously stored data is recalled, with each data stream being routed to one or more control inputs of the sound generating system via a the data-to-sound-parameter mapping. This causes the sonification sound to jump to the beacon state, allowing different states to be compared.

As shown in FIG. 3*a*, beacons data are retrieved by giving the name of a beacon data file. The values contained in that file 110 are then transferred by the computer to the beacon data memory 101. This file may of course represent either one set of values (for a static beacon) or a sequence of sets (for a dynamic beacon). The data for a beacon is created in a similar way, where the user specifies a file name, and the value (or values) in the beacon data memory 101 are read by the computer and placed in the file.

The use of pointers for the storage and retrieval of data for static beacons is illustrated in FIG. 3*b*. When a static beacon data is being retrieved, the user specifies the desired beacon by giving the name of the pointer beacon file 302 to the computer. Inside this file, there is another filename, for example 'test', which references a beacon data file 110. In addition, there is a pointer 304 (in the drawing example, '4') which references a particular data set in the beacon data file. The data set so referenced is then transferred by the computer to the beacon data memory 101. To create a static pointer beacon, the user first tells the computer to create a file and gives it a name. Then the user indicates the name of the associated beacon data file. Finally, the user would 'play' the beacon data file, so that each data set is transferred sequentially to the beacon data memory 101. When a data point of interest is selected via some button or key press, the index associated with the current data set is stored into the appropriate location of the pointer beacon file. It is also possible to create pointer-based beacon data files as data is coming in real-time. In this case, each time the user presses a button, a file is created (with some predetermined filename or sequence of filenames) and the current counter 60 value along with the name of a not-yet-written beacon data file are written to it.

The use of pointers for the storage and retrieval of dynamic beacon data is illustrated in FIG. 3*c*. Again, the user must first specify the desired beacon by giving the name of the pointer beacon file. This file contains a filename, for example 'test', which references a beacon data file 110. In addition, there is a pair of pointers 304 (in the drawing example, '4' and '30') which reference the starting and end points of the desired data range in the beacon data file 110. The computer will then transfer data sets sequentially, beginning with set '4' and continuing up through data set '30', in the example. To use pointers to create dynamic beacon data, the user first tells the computer to create a file and gives it a name. Then he indicates the name of the associated beacon data file. Finally, the user would 'play' the beacon data file, so that each data set is transferred sequentially to the beacon data memory 101. When a region of interest is encountered, a button or key can be held down for the duration of interest. Alternatively, the button could be pressed once at the beginning and again at the end of the range. The indices associated with the beginning and ending data sets, Pointer "Start" 304 and Pointer "End" 304, are then stored into the appropriate location of the pointer beacon file. Again, it is possible to create a dynamic pointer-based beacon data file as 'live' data is coming in, as described above.

Figure 4A:
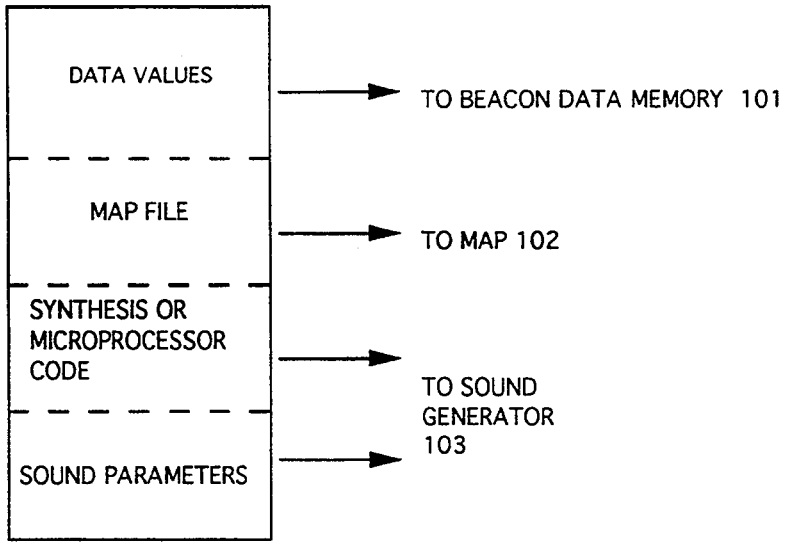
FIG. 4*a* shows the format of a beacon file.
Figure 4B:
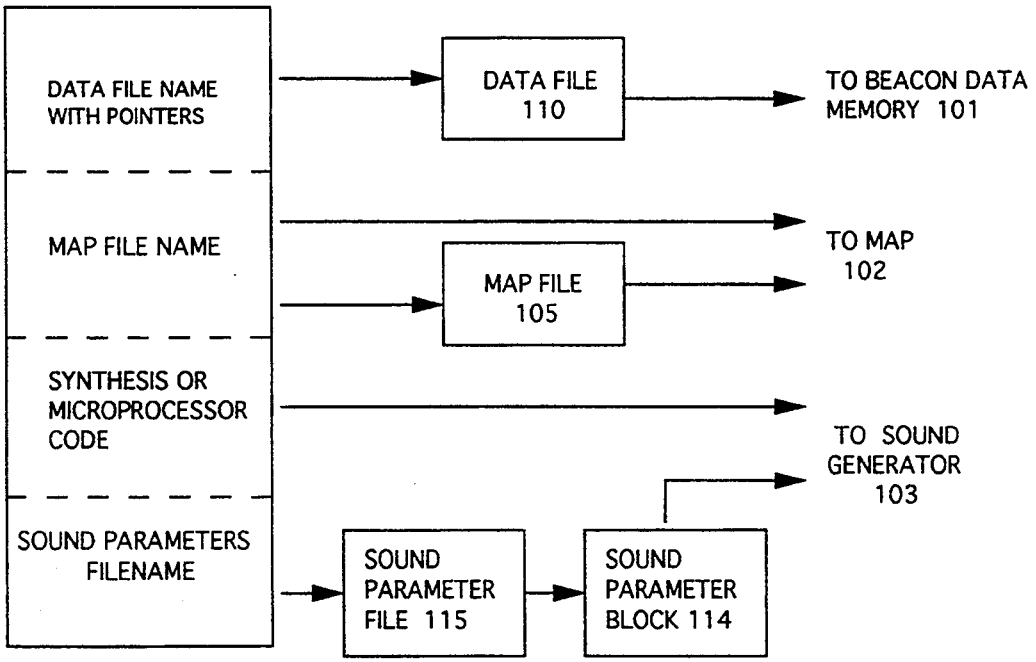
FIG. 4*b* shows an alternate format for a beacon file.

An auditory beacon file is a data structure in the file system which specifies all the information needed to describe a beacon, as described earlier. It can either contain this information directly, or refer to a set of files which contain the appropriate data. The formats of these two file types are shown in FIGS. 4*a* and 4*b* respectively. The direct beacon file format shown in FIG. 4*a* includes the data values (whether they reflect one point or a range of points), the mapping information required for the map unit, a code indicating the sound generating technique to use (or a reference to a file containing micro code to be downloaded to a DSP), and a set of sound parameters which will load the sound parameter block 114 accessed by the sound generator 103. The indirect beacon file format shown in FIG. 4*b* includes a filename referencing a beacon data file, a reference to a set of map values which will be placed into the map 102, a code indicating the sound generating technique to use (or a reference to a file containing micro code to be downloaded to a DSP), and a reference to a set of sound parameters 115 which will load the sound parameter block 114 accessed by the sound generator 103.

Note that the beacon can be thought of simply as a grouping mechanism whereby, through 'calling up' a beacon, several actions will be initiated, involving multiple data transfers. When multiple beacons having common elements are to be compared, as for example when the same data set is to be displayed using different mappings, it is not necessary to reload the data set. In other words, if two indirect auditory beacon files both reference the same data file, the system can avoid the process of re-loading the data.

It is also possible to circumvent the grouping mechanism afforded by the beacons and load specific data elements (data sets, map sets, sound parameters) directly by loading the respective files, if indeed they exist apart from being embedded in a direct auditory beacon file. The choice of whether or not to use the beacon grouping mechanism is entirely up to the system user.

Figure 5:
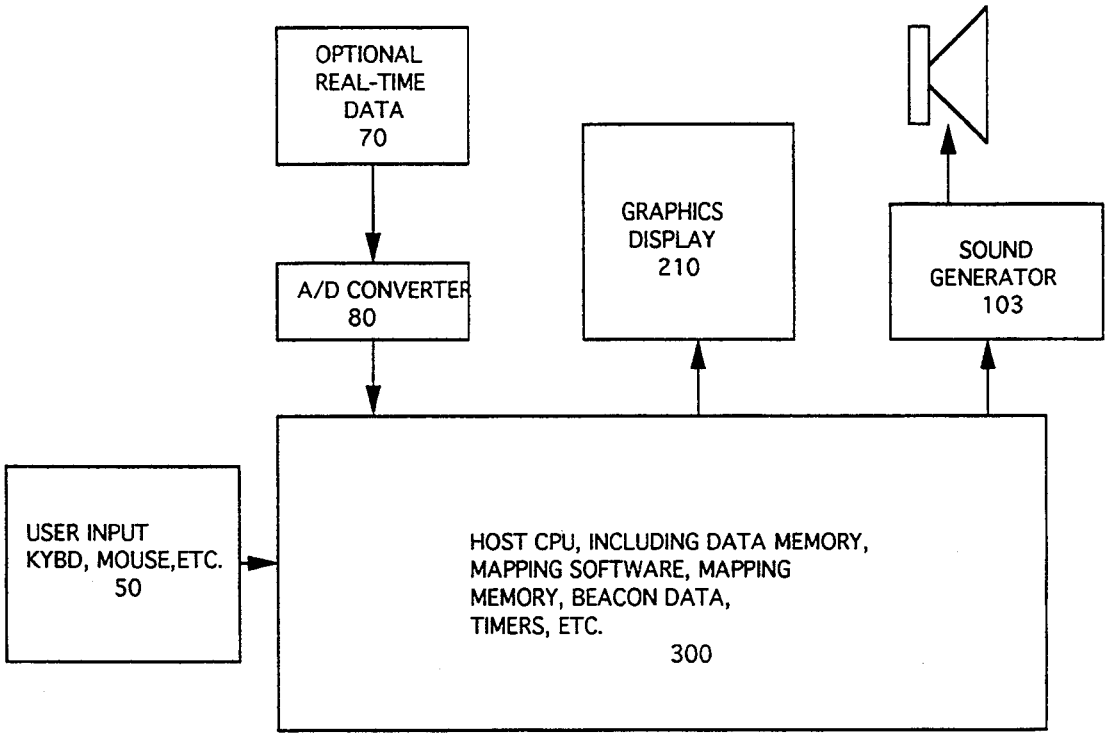
FIG. 5 is a diagram of a system incorporating the invention, including the host computer and attached graphic entry and display devices.

The complete system, as shown in FIG. 5, may incorporate a real-time data source 70, and analog to digital converter 80 which sends digital samples to the host CPU 300, which includes a sonification software architecture, incorporating data storage, mapping software, beacon data, timers, etc. A graphics display 210 provides the user with visual feedback. User input devices 211 are included, which can be a mouse or other pointing device, a keyboard, etc. A sound generator 103 is connected to a sound amplifier and speakers to create sound. This device can be either external, as shown in the figure, or it can be part of the hardware internal to the computer, e.g. as in an 'adapter card' on the computer's I/O bus.

The sound generator 103 is a piece of hardware (or software on a DSP chip) which is capable of producing signals whose spectral and temporal characteristics are responsive to some number of control parameters. This may be an implementation of any well-known synthesis technique (e.g. FM, additive synthesis, granular synthesis, etc.) or an original algorithm having characteristics specifically designed for the application. The control values output from the map 102 and the parameter block 114 are relevant only in the context of the sound generation scheme with which they were originally defined.

Figure 6:
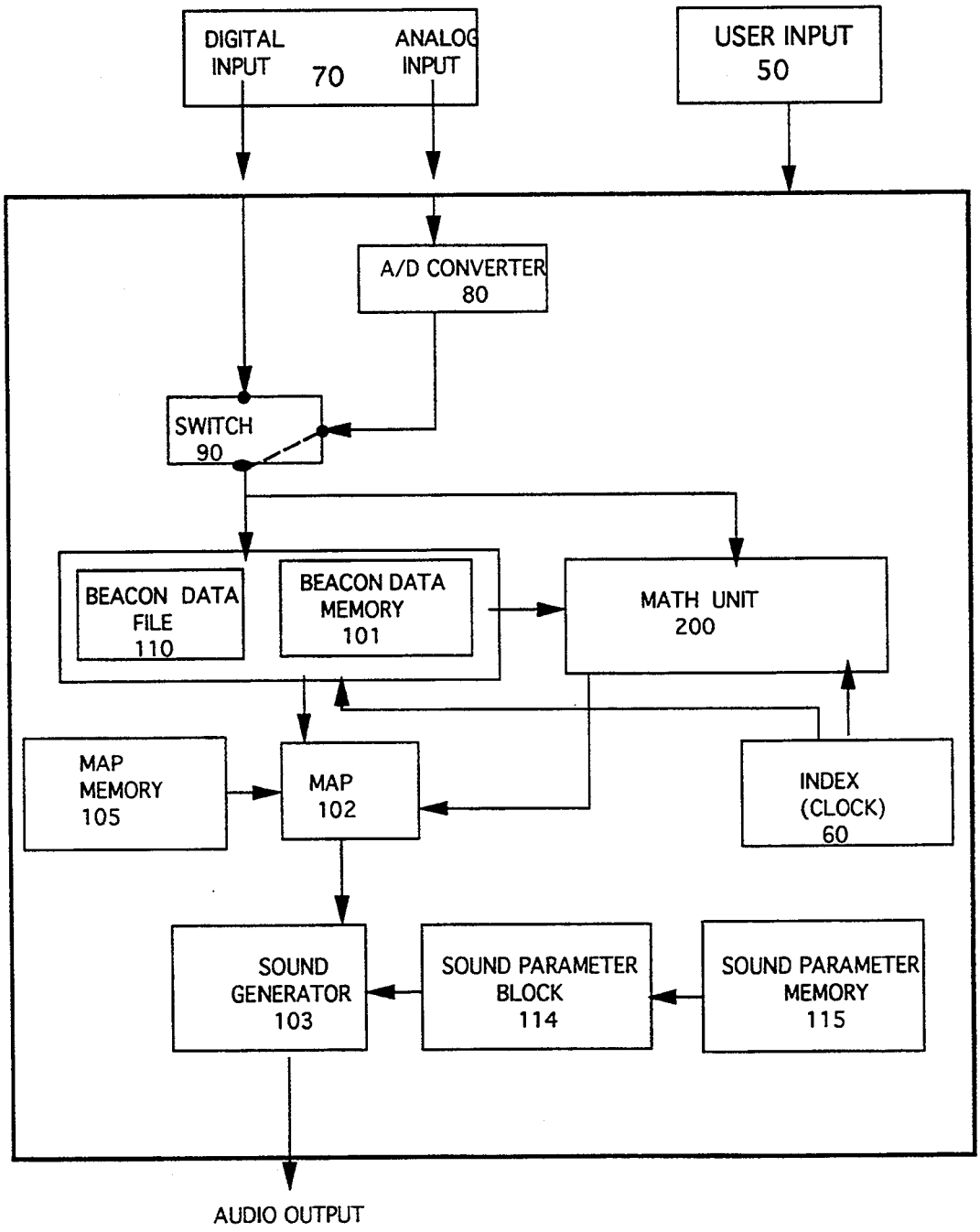
FIG. 6 is a diagram of a hardware implementation of the invention.

A hardware implementation, shown in FIG. 6, reflects the software architecture described above in a more compact form. Input data 70 may be digital or analog; if it is analog, it is converted to a digital signal via an A/D converter 80, and sent to a switch 90 which selects the data source. Control over this and other functions is via user input 50 such as a keypad or other device. This data is stored in beacon data memory 101 and either passed directly to the sound generator 103 via the map 102 or interpolated by a math unit 200 with previously stored data in beacon data memory 101 that the user has specified by controlling an index 60. Sets of sound parameters and mapping parameters are stored in the sound parameter memory 115 and map memory 105 respectively. Values from these memories are transferred to the sound parameter block 114 and the map 102 respectively whenever new values are required.

In the hardware implementation, explicit hardware memories 110, 105, and 115 take the place of the computer file system in a computer-based software implementation. Rather than referencing these data sets by filenames, they are selected through a more direct means, such as entering numbers on a keypad which identify the various blocks.

In the remaining discussion, the ideas described will not specifically refer to either a hardware or software implementation. Rather, they refer to functional blocks which may either be implemented in hardware or software.

Figure 7:
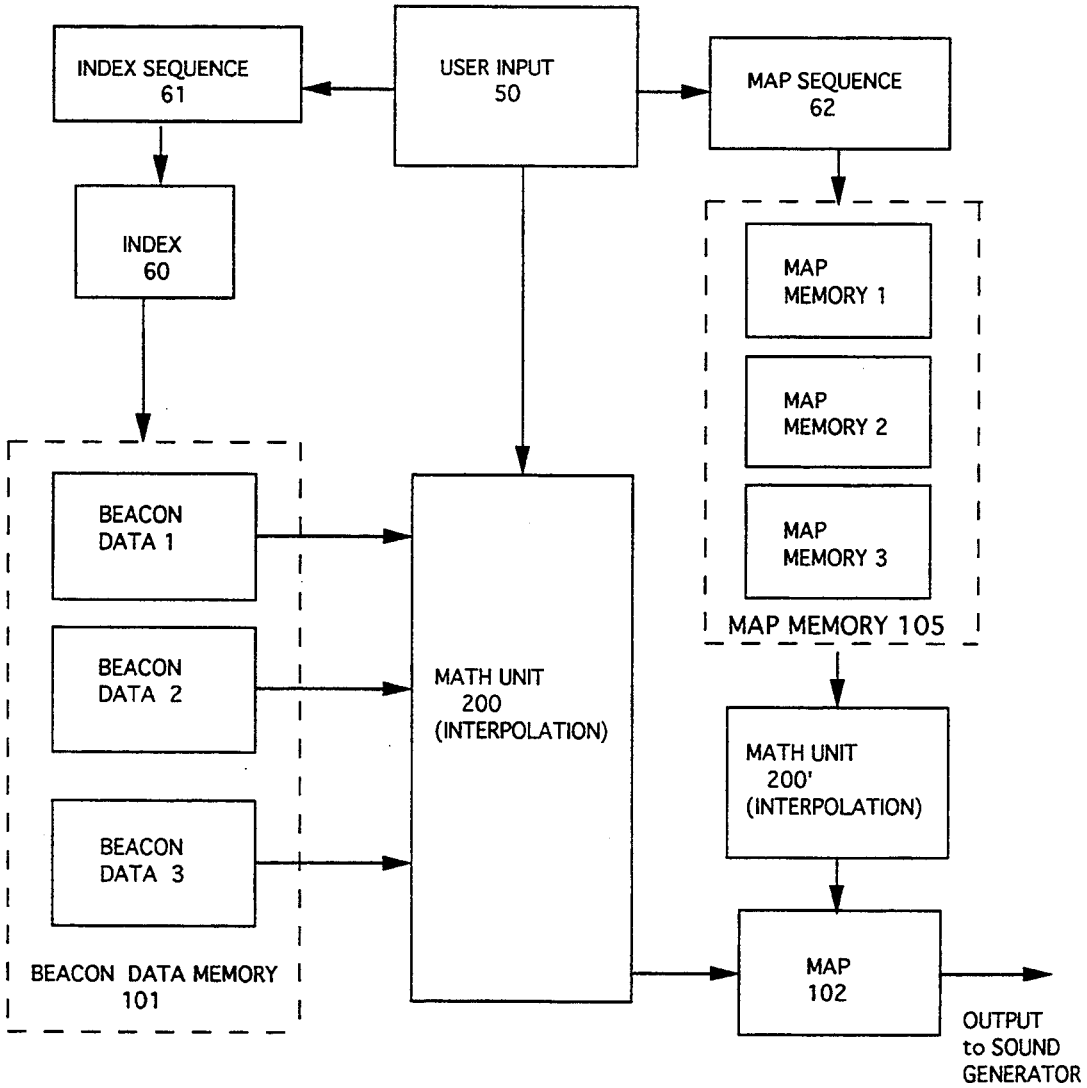
FIG. 7 is a system showing beacon sequencing, including multiple data sets and switching and/or interpolation means, and map sequencing, including multiple maps and switching or interpolation means.

FIG. 7 describes how the data component and map component of beacons may be sequenced. After storing several beacon data sets, the user may wish to compare these data by recalling them in a particular order at a given rate. First, the user would select via user input 50 a sequence 61 of indices pointing to which beacon data to recall 110 and which order to recall them in. When recalling the sequence, the index 60 of each beacon data set is used to look up the specific data values in the beacon data storage area. After a specified amount of time, the next index is used to look up the next data value. If the user wishes, the beacon data values may be interpolated via a math unit 200 to create a smooth transition from one beacon state to the next. Or the user may want to hear discrete beacons recalled.

This data is then mapped 102 to sonic parameters which are output to the sound generator. In a similar fashion, the user may wish to compare how a data value or values sound when mapped via a series of preselected mappings. The user may create and playback a map sequence 62 which points to a series of map parameter sets stored in the map memory 105. As these are recalled, they may be sent directly to the map 102 or intermediate map parameters may be interpolated by a math unit 200'. Entire beacons may be sequenced by changing beacon data and mappings in tandem.

Figure 8:
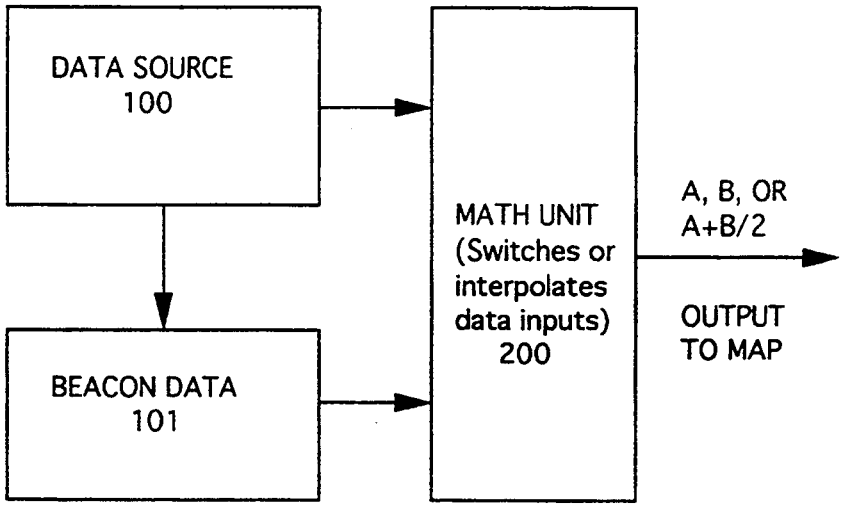
FIG. 8 is a diagram detailing how the beacon may be recalled and compared with values in a data stream.

FIG. 8 shows how beacon data may be recalled and compared with values in a data stream. Data from a source 100 is simultaneously fed to the math unit 200 and also selectively stored via user input 50 to the beacon data area 101. Beacon data 101 may be recalled as the data from the source 100 continues, and the math unit 200 will either switch or interpolate between the data from the data source or the beacon data area. The result is then output to the map.

Figure 9:
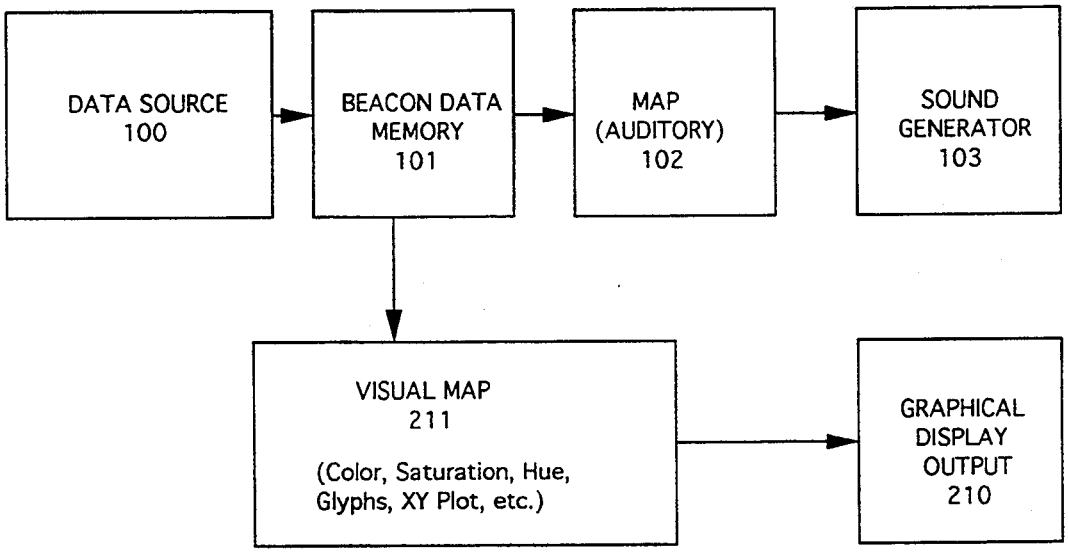
FIG. 9 is a diagram of an embodiment in which the auditory beacons are synchronized with visual beacons.

FIG. 9 shows the synchronized mapping of data to visual and auditory beacons. Selected data from a source 100 is stored in beacon data memory 101. When beacon data are recalled, they are simultaneously sent to an auditory map 102 and a visual map 211. The results from the auditory map 102 are sent to a sound generator 103, while the results from the visual map 211 is sent to a graphical display output 210. The visual map 211 describes how to represent input variables with visual variables, such as color, saturation, hue, glyphs, XY-plot, etc.

Figure 10:
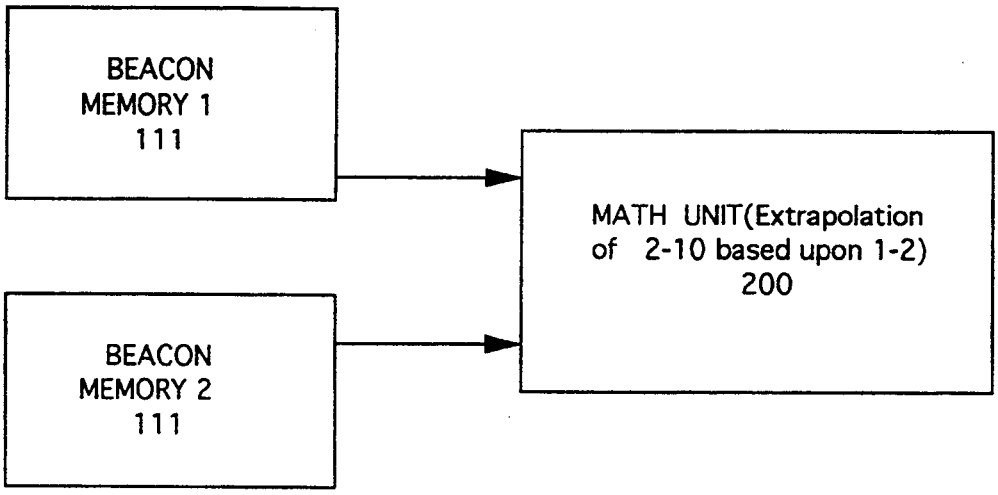
FIG. 10 is a system showing how extrapolation may be performed to determine the likely subsequent beacons based upon two or more beacons.

FIG. 10 shows how a math unit 200 may be used to extrapolate new values by performing a calculation with inputs from two distinct beacons. The values from auditory beacon memory 1 111-1 and auditory beacon memory 2 111-2 are input to the math unit, which may generate one or more set of output parameters that represent some combination or average of the first two.

I claim:

1. Sonification system for facilitating the interpretation and enhancing the comprehensibility of multi-variate data comprising:

input means for receiving a multi-variate data stream including plurality of separate and distinct data signals to be simultaneously monitored;

audio generating means including a plurality of audio generators each for generating a sonic data stream having desired auditory characteristics;

mapping means for selectively routing at least one of said data signals to be monitored to at least one of said audio generators;

beacon generator means for generating at least one beacon data signal which can be translated to an auditory beacon when routed through said mapping means to said audio generating means; and user control means for controlling which of said data and beacon data signals are routed to at least one of said generators by means of said mapping means, whereby sonic data streams and auditory beacons can be auditorially compared.

2. Sonification system as defined in claim 1, wherein said audio generators include means for accepting sound parameters which produce and define the desired auditory characteristics of the sonic data stream.

3. Sonification system as defined in claim 2, further comprising sound parameter memory means for storing sound parameters and selectively transferring sound parameters to said audio generators for modifying said audio generators and the resulting sonic data stream.

4. Sonification system as defined in claim 1, wherein said beacon generator means comprises beacon data memory means for storing a plurality of beacon data sets each defining another reference beacon data signal; and means for sequencing said plurality of beacon data sets in relation to said mapping means.

5. Sonification system as defined in claim 4, further comprising interpolation means between said beacon data memory means and said mapping means for interpolating said reference beacon data signals and providing a smooth transition from one auditory beacon to the next.

6. Sonification system as defined in claim 1, wherein said mapping means comprises map data memory means for storing a plurality of map parameter sets each defining another map configuration; and means for sequencing said map data memory means, whereby a comparison may be made of said sonic data stream sound when mapped via a series of pre-selected mappings.

7. Sonification system as defined in claim 6, wherein said mapping means comprises a map connected to said audio generating means, and further comprising interpolation means between said map data memory means and said map for interpolating said map parameter sets to provide a smooth transition from one sonic data stream to the next.

8. Sonification system as defined in claim 1, further comprising combining means for combining signals of said multi-variate data stream and at least one beacon data signal prior to being applied to said mapping means, whereby said signals may be simultaneously output to said audio generating means and sonically compared to each other.

9. Sonification system as defined in claim 8, wherein said combining means comprises an interpolation unit for interpolating said signals.

10. Sonification system as defined in claim 8, wherein said combining unit comprises a switching unit for switching said signals.

11. Sonification system as defined in claim 1, further comprising graphical display means and visual mapping means for translating said data and beacon data signals to video signals having visual variables and applying said video signals to said graphical display means, whereby said data and beacon data signals can be simultaneously generated and coordinated auditorially and graphically for visual and auditory comparisons.

12. Sonification system as defined in claim 1, wherein said audio generating means comprises a programmable digital signal processor (DSP).

13. Sonification system as defined in claim 1, wherein said user control means includes sampling means for selectively sampling signals of the multi-variate data stream and using the sampled signals as beacon data signals.

14. Sonification system as defined in claim 13, wherein said beacon generator means includes beacon data memory means for storing the sampled signals for subsequent use as beacon data signals.

15. Sonification system as defined in claim 14, wherein said beacon data memory means comprises a permanent storage data file.

16. Sonification system as defined in claim 1, wherein said beacon generator means comprises beacon data memory means for storing beacon data signals.

17. Sonification system as defined in claim 16, wherein said beacon data memory means comprises a permanent storage data file.

18. Sonification system as defined in claim 1, wherein said multi-variate data stream is in the real-time analog form and said user means includes an analog-to-digital converter for converting the data stream into digital format.

19. Sonification system as defined in claim 1, wherein said beacon generator means comprises beacon data memory means for storing a plurality of beacon data sets each defining another reference beacon data signal; and wherein said user control means includes means for selecting at least one of said beacon data sets.

20. Sonification system as defined in claim 1, wherein said mapping means comprises map data memory means for storing a plurality of map parameter sets each defining another map configuration; and wherein said user control means includes means for selecting at least one of said mapped parameter sets.

* * * * *